US009463621B2

(12) United States Patent
Kitabatake et al.

(10) Patent No.: US 9,463,621 B2
(45) Date of Patent: Oct. 11, 2016

(54) ELEMENT SUBSTRATE AND LIQUID DISCHARGING HEAD

(71) Applicant: CANON KABUSHIKI KAISHA, Tokyo (JP)

(72) Inventors: Kenji Kitabatake, Kawasaki (JP); Masao Mori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/740,700

(22) Filed: Jun. 16, 2015

(65) Prior Publication Data

US 2015/0367642 A1 Dec. 24, 2015

(30) Foreign Application Priority Data

Jun. 19, 2014 (JP) ..... 2014-126412

(51) Int. Cl.
*B41J 2/14* (2006.01)

(52) U.S. Cl.
CPC ..... *B41J 2/1412* (2013.01); *B41J 2/1404* (2013.01); *B41J 2/14088* (2013.01); *B41J 2202/11* (2013.01)

(58) Field of Classification Search
CPC .. B41J 2/1404; B41J 2/14088; B41J 2/1412; B41J 2/3354; B41J 2/33505; B41J 2/33585
See application file for complete search history.

(56) References Cited

U.S. PATENT DOCUMENTS

| | | | | |
|---|---|---|---|---|
| 5,831,643 | A | 11/1998 | Chung | |
| 2002/0113840 | A1 | 8/2002 | Trauernicht et al. | |
| 2006/0044347 | A1* | 3/2006 | Kwon | B41J 2/1603 347/44 |
| 2009/0148618 | A1 | 6/2009 | Fish et al. | |
| 2009/0160896 | A1 | 6/2009 | Yamagata | |

* cited by examiner

*Primary Examiner* — Geoffrey Mruk
(74) *Attorney, Agent, or Firm* — Canon U.S.A., Inc. IP Division

(57) ABSTRACT

An element substrate includes a discharge port from which liquid is discharged, an energy generating element configured to generate energy for discharging the liquid from the discharge port, a heating element having a shape with a longitudinal axis and including at least two heating surfaces exposed to the liquid, a first support portion configured to support one end portion of the heating element, a second support portion configured to support the other end portion of the heating element, and a third support portion configured to support a portion between the one end portion and the other end portion.

16 Claims, 3 Drawing Sheets

ELEMENT SUBSTRATE AND LIQUID DISCHARGING HEAD

BACKGROUND OF THE INVENTION

1. Field of the Invention

The present invention relates to an element substrate that discharges liquid by applying discharge energy to the liquid, and to a liquid discharging head including the element substrate.

2. Description of the Related Art

A liquid discharging head that discharges liquid is required to discharge small droplets having a volume of 2 pl or less. By applying such small droplets onto a printing medium at high density, a high-definition image can be obtained. With downsizing of the droplets, the number of discharges dramatically increases. When increasing the number of discharges, it has a limitation to simply increase the discharge frequency. Further, as the discharge frequency increases, the discharging speed sometimes decreases. To prevent the decrease in discharging speed and to discharge a predetermined amount of liquid in a shorter time, there has been adopted an element substrate in which multiple discharge ports are arranged at high density.

The element substrate that discharges liquid has a problem of the increase in viscosity of liquid due to the decrease in temperature of the liquid. To suppress such a problem, a method is adopted which heats liquid before supplying the liquid to action chambers that apply discharge energy to the liquid. However, in the element substrate that discharges small droplets, there is found a problem in that the discharge characteristics are deteriorated by the increase in viscosity with the increase in temperature of the liquid. That is, heated liquid evaporates via the discharge ports even when it stays in the action chambers. In the element substrate that discharges small droplets, the amount of liquid to be discharged from each discharge port is small. Hence, even when a small amount of solvent evaporates, the viscosity of the liquid easily increases. Further, since the discharge ports and the action chambers are relatively small, the liquid is likely to be affected by the increase in flow resistance due to the increase in viscosity. Such a problem is pronounced particularly in pigment ink that is likely to aggregate and high-function ink having a high content of additive resin.

The increase in flow resistance deteriorates the discharge characteristics of the element substrate. When the discharge characteristics are deteriorated, the element substrate is sometimes brought into a state in which it cannot discharge the liquid unless a recovery process is performed for liquid supply channels that reach the discharge ports and the action chambers.

U.S. Patent Application Publication No. 2009/160896 A1 discloses an element substrate that is controlled so that liquid in action chambers is not heated more than necessary.

In the element substrate described in the above publication, heating resistance elements serving as energy generating elements preheat the liquid in the action chambers to a predetermined temperature, and then discharge the liquid by boiling the liquid. However, it is difficult for the heat amount of preheating to rapidly heat the liquid. For this reason, in a low-temperature environment, a long standby time is required to heat the liquid to the predetermined temperature by preheating. This decreases the throughput of the element substrate.

In this way, the element substrate disclosed in the above publication cannot evenly cope with the increase in viscosity of the liquid within the usual use range. Further, to cope with the increase in viscosity of the liquid, it has been proposed to add heating elements different from the heat generating elements in the action chambers and to heat the liquid in the action chambers by the heating elements only by the necessary amount when needed. In such a case in which the heating elements are mounted in the substrate, most heat generated from the heating elements is transferred to the substrate, and this lowers the efficiency. Further, since the heat transferred to the substrate is stored in a liquid discharging head, it may continue heating the liquid even after the heating elements stop heating. For this reason, the heating state continues for a long time, and more liquid than necessary sometimes evaporates.

SUMMARY OF THE INVENTION

The present invention provides an element substrate and a liquid discharging head that efficiently heat liquid and achieve good discharge characteristics.

An element substrate according to an aspect of the present invention includes a discharge port from which liquid is discharged, an energy generating element configured to generate energy for discharging the liquid from the discharge port, a heating element having a shape with a longitudinal axis, including at least two heating surfaces exposed to the liquid, and configured to heat the liquid to an extent such as not to discharge the ink, a first support portion configured to support one end portion of the heating element, a second support portion configured to support the other end portion of the heating element, and a third support portion configured to support a portion between the first end portion and the other end portion.

Further features of the present invention will become apparent from the following description of exemplary embodiments with reference to the attached drawings.

DESCRIPTION OF THE EMBODIMENT

Figure 1:
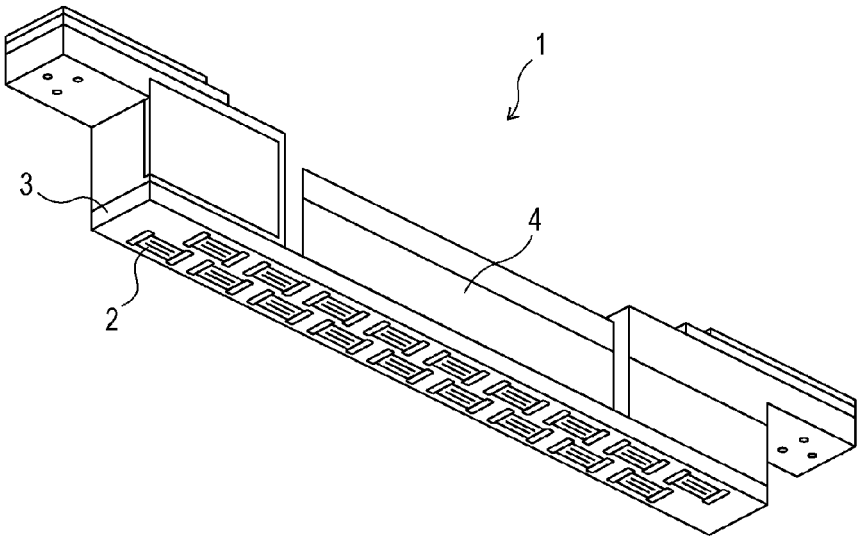
FIG. 1 is a perspective view of a liquid discharging head including an element substrate according to an embodiment of the present invention.

An embodiment of the present invention will be described below with reference to the drawings. FIG. 1 is a perspective view of a liquid discharging head including an element substrate according to the embodiment of the present invention. As illustrated in FIG. 1, a liquid discharging head 1 includes an element substrate 2 that discharges liquid such as ink, a support member 3 that supports the element substrate 2, and an electric wiring member 4 electrically connected to the element substrate 2. The liquid discharging head 1 illustrated in FIG. 1 can be mounted in a so-called full-line printing apparatus.

Figure 2:
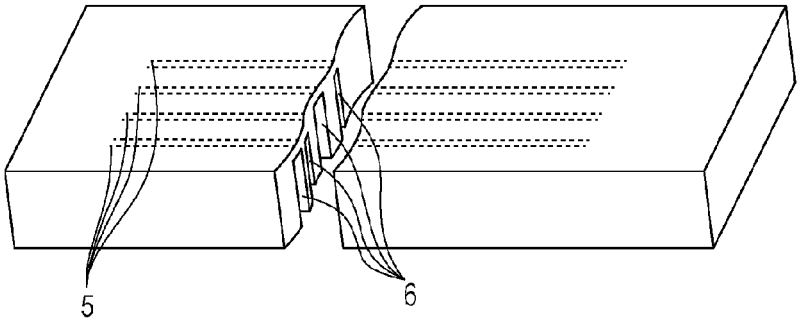
FIG. 2 is a partly cutaway perspective view of the element substrate according to the embodiment of the present invention.

FIG. 2 is a partly cutaway perspective view of the element substrate 2 illustrated in FIG. 1. To discharge inks of four colors of cyan, magenta, yellow, and black, the element substrate 2 includes discharge ports 5. The discharge ports 5 corresponding to each of the four colors are arranged in two rows.

Ink is supplied from ink reservoirs (not illustrated) to the discharge ports 5 via common liquid chambers 6 common to discharge port rows each two of which correspond to each color. The discharge ports 5 adjacent in a row direction are arranged at an array density of 800 dpi (dots per inch). Further, the discharge ports 5 in different rows for the same color are shifted from each other by a half pitch. Therefore, the element substrate 2 can apply ink onto a printing medium at a printing density of 1600 dpi.

Figure 3:
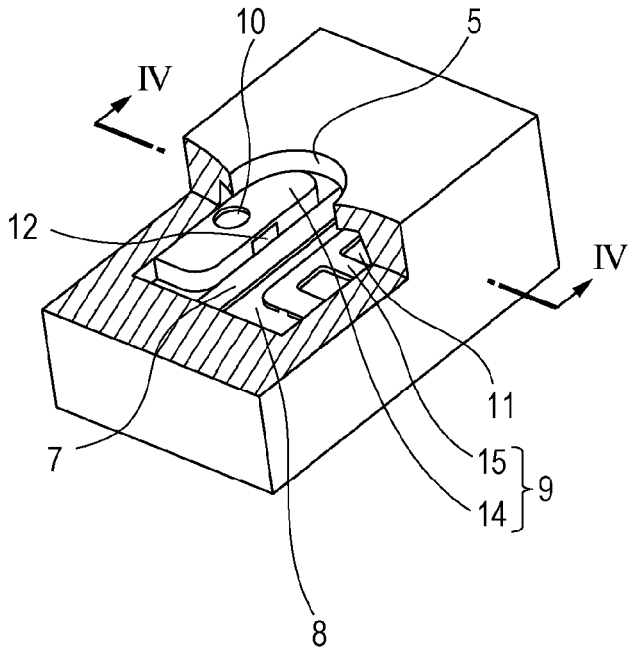
FIG. 3 is a partly cutaway enlarged perspective view of a section near a discharge port in the element substrate illustrated in FIG. 2.

FIG. 3 is a partly cutaway enlarged perspective view of a section near a discharge port 5 in the element substrate 2 illustrated in FIG. 2. As illustrated in FIG. 3, the element substrate 2 includes heating resistance elements 7 serving as energy generating elements that generate energy for discharging ink from the discharge ports 5, and action chambers 8 that apply the energy from the heating resistance elements 7 to the ink.

The action chambers 8 communicate with the common liquid chambers 6 (see FIG. 2), and the ink flows from the common liquid chambers 6 into the action chambers 8. The ink supplied to each action chamber 8 causes film boiling by thermal energy received from the heating resistance element 7 disposed within the action chamber 8, so that a bubble is produced in the ink. This bubble pushes and discharges the ink from the corresponding discharge port 5.

The heating resistance element 7 preferably has a shape with a longitudinal axis (for example, a platelike shape, a columnar shape, and a prismatic shape). In the embodiment, the heating resistance element 7 is shaped like a plate like a strip. Both ends of the heating resistance element 7 are fixed to a wall of the action chamber 8, and both surfaces of the heating resistance element 7 along the longitudinal axis are exposed to ink to be able to heat the ink. Therefore, heat can be applied to the ink from both surfaces of the heating resistance element 7. This allows the ink to cause film boiling in a shorter time.

Figure 4:
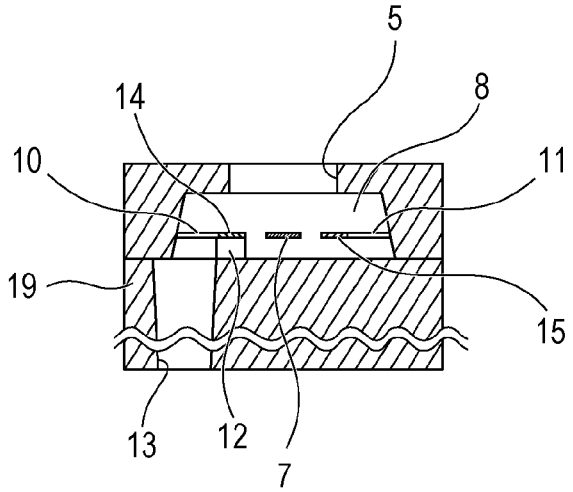
FIG. 4 is a cross-sectional view of the element substrate, taken along line IV-IV of FIG. 3.

The element substrate 2 further includes partitions 9 provided on both sides of each heating resistance element 7. The partitions 9 are formed of the same material as that of the heating resistance element 7 and by the same process as that for forming the heating resistance element 7. Hence, as illustrated in FIG. 4, the distance between the heating resistance element 7 and a substrate 19 and the distance between a heating element 15 and the substrate 19 are substantially equal to each other. The heating resistance element 7 and the partitions 9 divide the action chamber 8 into an upper space provided on a side of the discharge port 5 and a lower space provided on a side of a supply port 13 (upstream side) (by a virtual plane intersecting the discharging direction). One of the partitions 9 extends to a bottom wall of the action chamber 8 (a wall opposed to a wall having the discharge port 5), and divides the lower space of the action chamber 8 into a plurality of spaces.

The upper and lower spaces formed in the action chamber 8 communicate through gaps between the heating resistance element 7 and the partitions 9, an aperture 10 formed in one of the partitions 9, and a through hole 11 serving as an opening formed in the other partition 9. The plural spaces formed in the lower space of the action chamber 8 communicate through an aperture 12 provided in the one partition 9.

FIG. 4 is a cross-sectional view of the element substrate 2, taken along line IV-IV of FIG. 3. As illustrated in FIG. 4, the substrate 19 provided at a position opposed to the discharge port 5 has a supply port 13 communicating with the action chamber 8. More specifically, the supply port 13 penetrating the substrate 19 communicates with a space defined by the one partition 9. The space is closed except for the apertures 10 and 12. The one partition 9 functions as a rectifying element 14 that rectifies the flow of ink. In the embodiment, the element substrate 2 includes a plurality of action chambers 8. The supply port 13 is provided for each of the action chambers 8.

The other partition 9 includes a narrow portion, and the narrow portion is electrically connected to an electrode (not illustrated). The narrow portion generates heat by the application of voltage thereto via the electrode. That is, the narrow portion functions as a heating element (also referred to as a sub-heater) 15. The sub-heater 15 can be driven independently of the heating resistance element 7. Further, the sub-heater 15 is specified so that a bubble generating phenomenon does not occur even when the sub-heater 15 is driven alone. That is, the sub-heater 15 can heat the ink to an extent such as not to discharge the ink.

The sub-heater 15 of the embodiment is shaped like a plate having a longitudinal axis, and includes at least two heat generating surfaces. That is, both principal surfaces of the sub-heater 15 serve as heat generating surfaces. The heat generating surfaces are disposed at a predetermined distance from the substrate 19, and are both exposed to ink in the action chamber 8. In the embodiment, both ends of the sub-heater 15 are fixed to the wall of the action chamber 8, and both surfaces of the sub-heater 15 in the longitudinal direction are exposed to ink to be able to heat the ink. Therefore, heat can be applied from the surfaces of the sub-heater 15 to the ink, and this suppresses heat dissipation to the substrate 19. Hence, the ink can be heated to a predetermined temperature in a shorter time. The shape of the sub-heater 15 of the present invention is not limited to such a platelike shape, and may be, for example, a columnar shape or a prismatic shape.

The ink is supplied from the support member 3 (see FIG. 1) for supporting the element substrate 2 to the common liquid chamber 6 (see FIG. 2). The common liquid chamber 6 communicates with the supply port 13, and the ink flows into the action chamber 8 from the common liquid chamber 6 through the supply port 13. The element substrate 2 has a circuit (not illustrated) electrically connected to a liquid discharging apparatus body (not illustrated) in which the liquid discharging head 1 is mounted.

According to the embodiment, the ink in the action chamber 8 is heated by the sub-heater 15 when needed. For this reason, a state in which the temperature of the ink is high can be limited to the needed time in contrast to the related art in which the substrate is entirely heated. Hence, evaporation of the ink from the discharge port and evaporation of solvent in the ink can be suppressed more than before. Therefore, the increase in viscosity of the liquid can be suppressed. Further, since the sub-heater 15 is provided separately from the heating resistance element 7, the ink in the action chamber 8 can be heated to the predetermined temperature at an arbitrary timing.

Figure 5:
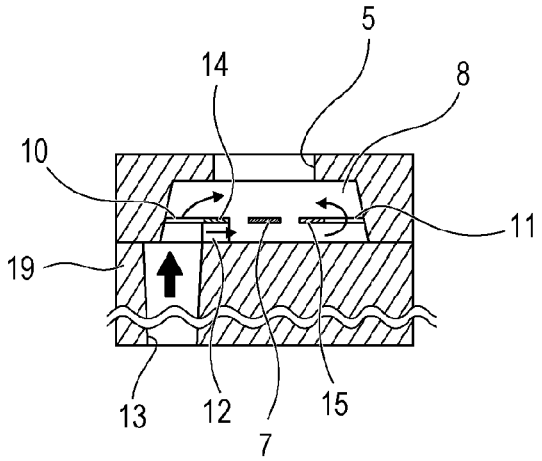
FIG. 5 is a cross-sectional view illustrating the flow of liquid.

Next, with reference to FIG. 5, a description will be given of the flow of ink that reaches the discharge port 5 from the supply port 13. FIG. 5 is a cross-sectional view illustrating the flow of ink from the supply port 13 to the discharge port 5.

When the ink is heated by the heating resistance element 7, it boils on the surfaces of the heating resistance element 7. Energy of ink boiling applies kinetic energy to the surrounding ink, and a bubble grows. Since the rectifying element 14 defines a closed space except for the apertures 10 and 12, it functions as a channel resistance that efficiently directs discharge energy to the ink near the discharge port 5.

After the ink in the action chamber 8 is discharged from the discharge port 5, the pressure in the grown bubble becomes a negative pressure. When the inertial force of ink transmitted during boil forming falls below the negative pressure, the bubble rapidly disappears. As a result, a force acts to take the ink into a region where the bubble was present. By virtue of this force, the ink flows into the action chamber 8 from the supply port 13.

At this time, the ink introduced from the supply port 13 first reaches the rectifying element 14, and flows into the upper and lower spaces of the action chamber 8 from the apertures 10 and 12 of the rectifying element 14, as shown by arrows in FIG. 5. A space on a back side of the heating resistance element 7 (a space opposite from the discharge port 5) is filled with ink by this flow.

The liquid passing through the back side of the heating resistance element 7 further flows to a position near the sub-heater 15, and flows into the space on the side of the discharge port 5 through the through hole 11. In this specification, a channel through which the ink reaches the region on the side of the discharge port 5 through the through hole 11 is referred to a "bypass channel". In other words, the through hole 11 forms a part of the bypass channel, and the sub-heater 15 serves as a channel wall of the bypass channel. The ink flows through the bypass channel and the aperture 10, and is then supplied to a front side of the heating resistance element 7 (a side of the discharge port 5).

Next, the structure of the sub-heater 15 will be described in detail.

The liquid discharging head of the related art mainly includes the sub-heater for the purpose of suppressing the increase in viscosity of ink in a low-temperature environment. In this case, the sub-heater is often provided on a member having high thermal conductivity (for example, a liquid discharging head board or a support member also having a heat dissipating function) in terms of the design such as to heat the entire liquid discharging head and advantageous arrangement layout. In such a structure, heat is dissipated from the liquid discharging head. Therefore, the sub-heater requires not only the heat quantity that heats the entire liquid discharging head, but also the heat quantity that covers the heat to be dissipated. As a result, a considerably large-sized sub-heater is needed. In such a large-sized sub-heater (provided on the member having high thermal conductivity), since it is difficult to finely control the temperature, a heating resistance element preheats ink to adjust the temperature of the ink in environments other than a normal temperature environment. This is because the discharge amount subtly changes with the decrease in viscosity in the high-temperature environment and the optical density (OD) of a printed image increases. This phenomenon is likely to be conspicuous in a high-duty image.

The phenomenon in which the optical density of the printed image is increased by the increase in temperature is more conspicuous in the above-described environment in which small droplets are discharged. This is because the ratio of the increase in discharge amount with respect to discharge droplets increases.

Further, as described above, the high-temperature environment in discharging of small droplets also causes thickening due to evaporation. That is, the high-temperature environment in discharging of small droplets causes the decrease in viscosity resulting from the increase in kinetic energy of the liquid in the short term, and then causes the increase in viscosity resulting from evaporation of moisture in the ink in the long term. In this way, in the element substrate for discharging small droplets, it is seriously difficult to control the viscosity.

Accordingly, in the embodiment, the sub-heater that performs heating with front and back surfaces is provided within the action chamber 8. To efficiently heat only a required amount of ink when needed, it is preferable that the ink between the discharge port and the heating resistance element should be heated and the ink upstream of the heating resistance element should be hardly heated. In this case, heating in a short time is possible, the ink does not evaporate more than necessary, and the backward resistance is ensured on the upstream side of the heating resistance element. This enhances the discharge efficiency. When the heating element 15 serving as the sub-heater is disposed on the downstream side of the heating resistance element 7 in the flow direction of liquid in the action chamber 8, heating of the ink upstream of the heating resistance element 7 is minimized. From a different viewpoint, as illustrated in FIG. 4, the substrate 19 has the supply port 13. The distance between the supply port 13 and the sub-heater 15 is larger than the distance between the supply port 13 and the heating resistance element 7. Because of this relationship, the liquid on the further downstream side (side closer to the discharge port 5) in the flowing direction of liquid can be heated to decrease the viscosity, and discharging can be performed properly. In more detail, the distance between the supply port 13 and the sub-heater 15 is smaller than the distance between the supply port 13 and the discharge port 5 and larger than the distance between the supply port 13 and the heating resistance element 7.

When the heating resistance element and the sub-heater are provided in the member having high thermal conductivity, heat generated from the heating resistance element and the sub-heater is transferred not only to the ink, but also to the member having high thermal conductivity. Therefore, the member having high thermal conductivity is sometimes unsuitable for the element substrate that discharges small droplets, for example, because a sub-heater having a certain size is needed and a large area is required between the heating resistance element and the discharge port.

In addition, heat transferred to the member having high-thermal conductivity is stored in other members within the liquid discharging head. For this reason, even after the sub-heater stops heating the ink, the heat stored in the other members is likely to heat the ink. As a result, the heating state continues for a long time, and more ink than necessary easily evaporates.

In the embodiment, the sub-heater 15 is shaped like a long plate, and is provided within the action chamber 8 with its front and back surfaces being exposed to the ink. More specifically, shorter-side portions of the long plate are fixed to the wall of the action chamber 8. Therefore, heat generated by the sub-heater 15 is unlikely to be transferred to the wall of the action chamber 8. Further, since the front and back surfaces of the sub-heater 15 are exposed to the ink, the ink can be heated efficiently.

Moreover, according to this structure, the amount of ink to be heated is far smaller than in the liquid discharging head of the related art. Therefore, it is unnecessary to change the dimension between the heating resistance element 7 and the discharge port 5 to add the sub-heater 15. Further, most heat generated by the sub-heater 15 is transferred only to the ink to be discharged. Therefore, the ink is unlikely to evaporate, and the increase in viscosity can be minimized. In addition, since the ink within the action chamber is heated, the temperature can be adjusted speedily. Therefore, the standby time during a warm-up can be made shorter than in the element substrate of the related art in which only preheating is performed by the heating resistance element. Since the element substrate 2 of the embodiment can expand the range of temperature adjustment of the ink and can speedily adjust the temperature, it is easier to correct discharging variation during printing.

To more effectively enjoy the effect of temperature adjustment with the sub-heater 15, the heating resistance element 7 preferably adopts a structure for performing heating with front and back surfaces, similarly to the sub-heater 15. When a protective layer is provided on the surface of the heating resistance element 7, extra energy is needed, and accumulated heat in the protective layer sometimes affects the temperature adjustment. From the viewpoint of temperature management in the action chamber 8, the heating resistance element 7 and the sub-heater 15 are preferably formed of a material having sufficient durability without using the protective layer. Such a material of the heating resistance element 7 and the sub-heater 15 is, for example, an amorphous-based high-resistance material mainly composed of a high-melting-point metal such as TiAlN. Alternatively, the material may be a laminate of TiAlN and TiAl.

From the viewpoint of enhancement of discharging efficiency, the sub-heater 15 is preferably disposed at a position such as to speedily heat the ink near the heating resistance element 7 and such as to be out of the area between the discharge port 5 and the heating resistance element 7 that may affect discharging. Such a position is, for example, a position on the partition 9, which forms the bypass channel, on the side of the heating resistance element 7.

Further, from the viewpoint of heating efficiency of the sub-heater 15, it is preferable that the electric resistance of the sub-heater 15 should be higher. Although the electric resistance can be increased by selecting a material having high specific resistance, when the same material is used, the electric resistance can also be increased by decreasing the cross-sectional area of the sub-heater 15, that is, by decreasing the thickness of the sub-heater 15.

When the thickness of the sub-heater 15 is decreased, the mechanical strength of the sub-heater 15 decreases. Since the sub-heater 15 repeats heating, it suffers structural fatigue due to thermal stress. Further, the sub-heater 15 itself vibrates owing to, for example, a Karman vortex caused by movement of the ink through the through hole 11 of the sub-heater 15 and its surroundings, and accumulation of vibration may cause structural fatigue. If the sub-heater 15 is used in the state of structural fatigue, it is broken, and this causes trouble with the element substrate 2 and the liquid discharging head 1.

Figure 6:
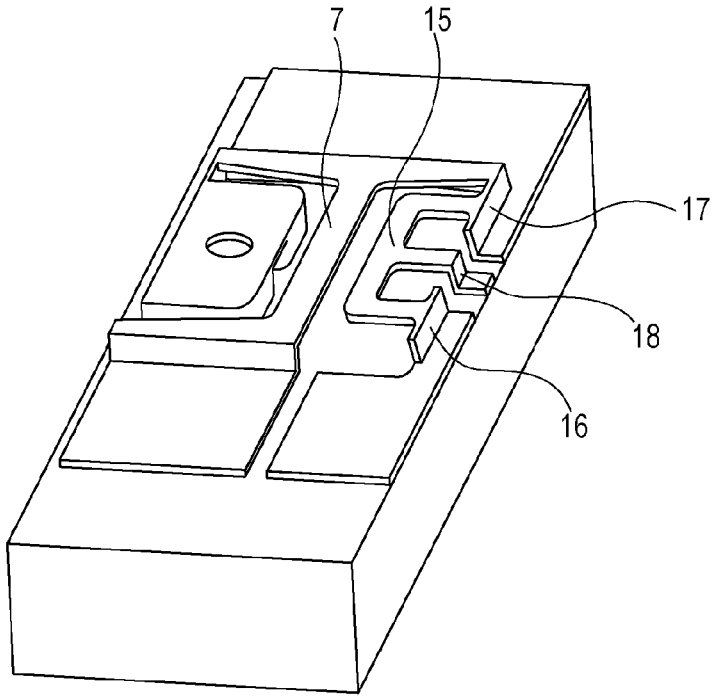
FIG. 6 is an enlarged partial perspective view of the surroundings of a heating resistance element and a heating element.

In the embodiment, as illustrated in FIG. 6, the element substrate 2 further includes first and second support portions 16 and 17, and a third support portion 18 provided separately of the first and second support portions 16 and 17. The first and second support portions 16 and 17 are provided in one end portion and the other end portion of the sub-heater 15, respectively, and are formed by bending parts of a member that forms the sub-heater 15 to support both end portions of the sub-heater 15. Voltage can be applied between the one end portion and the other end portion of the sub-heater 15. Similarly, the third support portion 18 is also formed by bending a part of the sub-heater 15 to support a portion of the sub-heater 15 between both end portions. In this way, parts of the sub-heater 15 are bent to form bent parts serving as support portions on the substrate 19.

According to this structure, even when both surfaces of the heat generating part of the sub-heater 15 are separate from the substrate 19 and are exposed to the ink, rigidity of the entire sub-heater 15 can be increased, breakage resulting from thermal stress and structural fatigue due to vibration can be prevented, and the operating life can be lengthened. Further, the sub-heater 15 can be prevented from being broken by vibration or unexpected fall during transportation of the liquid discharging head 1 or a liquid discharging apparatus (not illustrated) incorporating the liquid discharging head 1.

The third support portion 18 is preferably connected to the wall of the action chamber 8 with an insulator being disposed therebetween. By electrically insulating the third support portion 18 from the wall of the action chamber 8, thermal diffusion to the wall of the action chamber 8 (substrate main body and discharge-port forming member) due to free electrons can be prevented, and the decrease in efficiency of the sub-heater 15 can be avoided. Further, when the third support portion 18 is electrically insulated from the wall of the action chamber 8, it becomes an electrically suspended component, and does not greatly change the total resistance of the sub-heater 15. Therefore, the sub-heater 15 can ensure an amount of heat generation similar to that when the third support portion 18 is not provided. As illustrated in FIG. 6, the sub-heater 15 and the heating resistance element 7 extend along each other and along the surface of the substrate 19.

In the embodiment, the supply port 13 is provided in each action chamber 8, and the channel length of the supply port 13 is longer than the channel length from an exit end of the supply port 13 to the discharge port 5. This structure can make the backward resistance of the ink high and can make the forward resistance low. Thus, the discharge efficiency can be further enhanced in combination with the liquid resistance at the supply port 13 having a length more than or equal to the predetermined length.

While the heating resistance element 7 is used as the energy generating element in the embodiment, a piezoelectric element having a vibrating plate may be used as the energy generating element. When the energy generating element is the piezoelectric element, the sub-heater 15 is preferably disposed at a position such as to be opposed to the piezoelectric element within the action chamber 8 and such as to be shifted to a fixed portion of the vibrating plate on a side of the discharge port 5.

While the present invention is applicable to any kind of ink, it is advantageous particularly for pigment ink that is likely to aggregate and high-function ink having a high content of additive resin. The present invention is, of course, not limited to the element substrate that discharges ink, and is also applicable to an element substrate that discharges liquid.

While the heating element 15 serving as the sub-heater is provided within the action chamber 8 in the above-described embodiment, the present invention is not limited thereto. The heating element may be provided at any position as long as it is exposed to liquid in the liquid discharging head. For example, the heating element may be provided within the supply port 13, the channel communicating between the supply port 13 and the action chamber 8, or the common liquid chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-126412, filed Jun. 19, 2014, which is hereby incorporated by reference herein in its entirety.

What is claimed is:

1. An element substrate comprising:

a discharge port from which liquid is discharged;

an energy generating element configured to generate energy for discharging the liquid from the discharge port;

an action chamber in which the energy generating element is provided;

a heating element having a shape with a longitudinal axis, including at least two heating surfaces exposed to the liquid, and configured to heat the liquid to an extent such as not to discharge the liquid;

a first support portion configured to connect one end portion of the heating element and a wall of the action chamber;

a second support portion configured to support the other end portion of the heating element and the wall of the action chamber; and a third support portion configured to connect a portion between the one end portion and the other end portion and the wall of the action chamber, wherein a first through hole is formed by the heating element, the first support portion, the third support portion and the wall of the action chamber, and a second through hole is formed by the heating element, the second support portion, the third support portion and the wall of the action chamber.

2. The element substrate according to claim 1, wherein the heating element is provided in an area outside of an area between the energy generating element and the discharge port.

3. The element substrate according to claim 1, further comprising:

wherein the third support portion is connected to the wall of the action chamber with an insulator being disposed therebetween.

4. The element substrate according to claim 3, wherein the energy generating element is a heating resistance element provided in the action chamber in a state in which two surfaces of the heating resistance element along the longitudinal axis are exposed to the liquid in the action chamber.

5. The element substrate according to claim 3, wherein the action chamber includes a bypass channel configured to connect the two surfaces of the energy generating element, and the heating element is provided in the bypass channel.

6. The element substrate according to claim 3, further comprising:

a supply port communicating with the action chamber, wherein a channel length of the supply port is longer than a channel length from an exit end of the supply port to the discharge port.

7. The element substrate according to claim 1, wherein the energy generating element is a piezoelectric element having a vibrating plate.

8. The element substrate according to claim 7, wherein the heating element is disposed at a position opposing the piezoelectric element and such as to be shifted to a fixed portion of the vibrating plate on a side of the discharge port.

9. The element substrate according to claim 1, further comprising:

an action chamber in which the energy generating element is provided, wherein the heating element is disposed within the action chamber.

10. The element substrate according to claim 1, wherein the first and second support portions include bent portions of the heating element.

11. A liquid discharging head comprising:

the substrate according to claim 1, wherein the third support portion includes a bent portion of the heating element.

12. An element substrate comprising:

a discharge port from which liquid is discharged;

an energy generating element configured to generate energy for discharging the liquid from the discharge port;

a substrate having a supply port from which the liquid is supplied to the energy generating element; and a heating element having a heating surface disposed at a distance from the substrate, and configured to heat the liquid to an extent such as not to discharge the liquid, wherein one end portion, the other end portion, and a portion between the one end portion and the other end portion of the heating element are connected to the substrate, and wherein a through hole is formed by the heating element and the substrate.

13. The element substrate according to claim 12, wherein the portions of the heating element supported by the substrate are bent portions formed by bending the heating element.

14. The element substrate according to claim 13, wherein the heating element has an aperture through which the liquid flows.

15. The element substrate according to claim 12, wherein the energy generating element and the heating element are formed of the same material.

16. A liquid discharging head comprising:

an element substrate including:

a discharge port from which liquid is discharged;

an energy generating element configured to generate energy for discharging the liquid from the discharge port;

an action chamber in which the energy generating element is provided a heating element having a shape with a longitudinal axis, including at least two heating surfaces exposed to the liquid, and configured to heat the liquid to an extent such as not to discharge the liquid;

a first support portion configured to connect one end portion of the heating element;

a second support portion configured to connect the other end portion of the heating element and a wall of the action chamber;

a third support portion configured to connect a portion between the one end portion and the other end portion and a wall of the action chamber, wherein a first through hole is formed by the heating element, the first support portion, the third support portion and the wall of the action chamber, and a second through hole is formed by the heating element, the second support portion, the third support portion and the wall of the action chamber.

* * * * *